US005665004A

United States Patent [19]

Vlahovic

[11] Patent Number: 5,665,004

[45] Date of Patent: Sep. 9, 1997

[54] AUTOMATIC GOLF BALL DISPENSER

[76] Inventor: Gene Vlahovic, W141 N5275 Thornhill Ct., Menomonee Falls, Wis. 53051

[21] Appl. No.: 730,583

[22] Filed: Nov. 25, 1996

[51] Int. Cl.[6] ..... A63B 69/36

[52] U.S. Cl. ..... 473/137; 473/134

[58] Field of Search ..... 473/132, 133, 473/134, 135, 136, 137

[56] References Cited

U.S. PATENT DOCUMENTS

| | | | |
|---|---|---|---|
| 1,868,261 | 7/1932 | Spencer | 473/134 |
| 1,940,321 | 12/1933 | Pagett | 473/137 |
| 2,071,356 | 2/1937 | Pagett | 473/137 |
| 3,003,770 | 10/1961 | Jones | 473/137 |
| 4,146,232 | 3/1979 | Stone | 473/137 |
| 4,360,204 | 11/1982 | Karr | 473/137 |
| 4,391,446 | 7/1983 | Eberle | 473/137 |
| 4,796,893 | 1/1989 | Choi | 473/137 |
| 4,892,318 | 1/1990 | Jennings | 473/137 |
| 5,346,222 | 9/1994 | Luther, Sr. | 473/137 |
| 5,549,518 | 8/1996 | Wang | 473/137 |
| 5,599,237 | 2/1997 | Fetterman et al. | 473/137 |

*Primary Examiner*—Steven B. Wong
*Attorney, Agent, or Firm*—Donald J. Ersler

[57] ABSTRACT

An automatic golf ball dispenser includes a loading assembly, a base, and a delivery assembly. The loading assembly includes a bowl and a supply tube. The volume of the bowl is structured to hold a large quantity of golf balls. The bowl is sized to snugly fit into the supply tube. The base includes a platform, a tee, and a projection. The loading assembly is rigidly connected to the base, but may be quickly removed. A tee is fastened to the platform at the opposite end thereof. The delivery assembly comprises a delivery tube, a loading interface, a stop, and a plug. The loading interface is fastened to the first end of the delivery tube. The first end of the delivery assembly is pivotally connected to the loading assembly at substantially the second end thereof. A stop is fastened to the bottom of the delivery tube at the first end thereof. When the delivery tube is swung downward, a ball falls through a first cutout of the delivery tube and rolls to a second cutout of the delivery tube. The ball falls through the second cutout and rests on the tee. The delivery assembly then retracts to an upright position. The delivery tube may be actuated in a semi-automatic or fully automatic mode.

20 Claims, 3 Drawing Sheets

AUTOMATIC GOLF BALL DISPENSER

BACKGROUND OF THE INVENTION

1. Field of the Invention

The present invention relates generally to automatic golf ball dispensers and more specifically to an automatic golf ball dispenser which is less complex, is easily transported, and can hold a larger quantity of golf balls than the prior art.

2. Discussion of the Prior Art

An automatic golf ball dispenser is used to place a golf ball on a tee with little physical effort. The golfer need not bend over, pick a golf ball out of a bucket, and manually place the golf ball on a tee. Instead, a hopper is filled with golf balls which are delivered to a tee when a foot pedal is depressed, a lever is pulled with a golf club, or a rod is pushed down with the stroke of a foot. There are several designs of automatic golf ball dispensers. Unfortunately, each design has a drawback which makes its design less than satisfactory.

The least complicated of the prior art automatic golf ball dispensers is U.S. Pat. No. 1,940,321 by Pagett. Unfortunately, this design has several drawbacks. The Pagett '321 patent lacks a bowl for holding a large number of golf balls, the tube must be refilled often. The tee is a complicated and expensive mechanism which can be simplified. The Pagett '321 device is held in the ground with a sharp spike, which must be removed each time for storage. If the Pagett '321 device is accidently mishandled the sharp spike could result in severe injury to the golfer or an innocent bystander. The Pagett '321 patent also does not suggest or teach how the device could be adapted for fully automatic golf ball dispensing. Lastly, the Pagett '321 patent contains no suggestion of how it might be mounted for permanent usage at a driving range.

Accordingly, there is a clearly felt need in the art for an automatic golf ball dispenser which is safe to handle, is less complex than the prior art, can hold a large quantity of golf balls, has a simple tee, can be permanently mounted, and is fully automated.

SUMMARY OF THE INVENTION

The primary objective of the present invention is to provide an automatic golf ball dispenser which is safe to handle, is less complex than the prior art, can hold a large quantity of golf balls, has a simple tee, can be permanently mounted, and is fully automated.

According to the present invention, an automatic golf ball dispenser includes a loading assembly, a base, and a delivery assembly. The loading assembly comprises a bowl and a supply tube. The bowl has a first end, a second end, and a substantial volume. The first end of the bowl has an opening which is substantially larger than the opening at the second end. The volume of the bowl is structured to hold a large quantity of golf balls. The supply tube has a first end, a second end, and a substantial length. The second end of the bowl is terminated with a neck which is sized to snugly fit inside the first end of the supply tube.

The base comprises a platform, a tee, and a projection. The platform has a first end, and a second end. The tee is the same as those commonly used at a driving range. The tee is fastened to the platform at the second end thereof. The projection is disposed at the first end of the platform and is sized to slidably fit into the second end of the supply tube. A bore is formed through the second end of the supply tube and the projection such that a bolt maybe inserted therethrough and rigidly retain the loading assembly in relation to the platform.

The delivery assembly comprises a delivery tube, a loading interface, a stop, and a plug. The delivery tube has a first end, second end, a top surface, a bottom surface, and a substantial length. The plug is inserted into the second end of the delivery tube. A second cutout is formed at substantially the second end of the delivery tube in the bottom surface thereof, the second cutout originates at the end of the plug. The second cutout is sized to allow a golf ball to pass through the delivery tube on to a tee. The loading interface is fastened to the first end of the delivery tube. A first cutout is formed at substantially the first end of the tube in the top surface thereof, the first cutout originates at the end of the loading interface. The first cutout is sized to allow a golf ball to pass through the supply tube into the delivery tube.

A pivot bracket is fastened to the supply tube at substantially the second end thereof. The pivot bracket has a U-shaped cross section which fits securely around the diameter of the supply tube. A bore is formed through the pivot bracket and the loading interface, a bolt is inserted therethrough such that the loading assembly pivots in relation to the delivery assembly. A stop is fastened to the bottom of the delivery tube at the first end thereof.

The automatic golf ball dispenser can place a golf ball on a tee through either semi-automatic or fully automatic action. In semi-automatic mode, a large number of golf balls are placed in the bowl and fall down the supply tube until the first golf ball contacts the first profile of the loading interface. The golfer can use a golf club to pull a rod fastened to the loading assembly downward until the stop of the delivery tube contacts the supply tube. The maximum angular swing of the delivery tube as limited by the stop is greater than 90 degrees to allow gravity to pull the golf ball down the delivery tube. The golfer swings the delivery tube downward until the stop hits supply tube and then releases the delivery tube, a golf ball is placed on the tee.

In fully automatic mode, a foot pedal switch may be depressed to engage an automated device which lowers the delivery tube. The automated device can be a motor with a linkage system, a pneumatic cylinder, or an electric cylinder. The automated device is fastened to the platform and manipulates the swing of the delivery tube. It is also possible to replace the foot pedal switch with a photosensor which detects the presence of a golf ball on the tee. If the golf is missing, the photosensor sends a message to the automated device to lower the delivery tube which places another golf ball on the tee.

Accordingly, it is an object of the present invention to provide an automatic golf dispenser which is less complex than that of the prior art.

It is a further object of the present invention to provide an automatic golf dispenser which has a capacity to hold a large quantity of golf balls.

It is yet a further object of the present invention to provide an automatic golf dispenser which has a simple tee.

It is yet a further object of the present invention to provide an automatic golf dispenser which is safe to handle.

It is yet a further object of the present invention to provide an automatic golf dispenser which can be operated in a semi-automatic mode or fully automatic mode.

Finally, it is another object of the present invention to provide an automatic golf dispenser which can be permanently mounted or easily transported.

These and additional objects, advantages, features and benefits of the present invention will become apparent from the following specification.

DETAILED DESCRIPTION OF THE PREFERRED EMBODIMENTS

Figure 1:
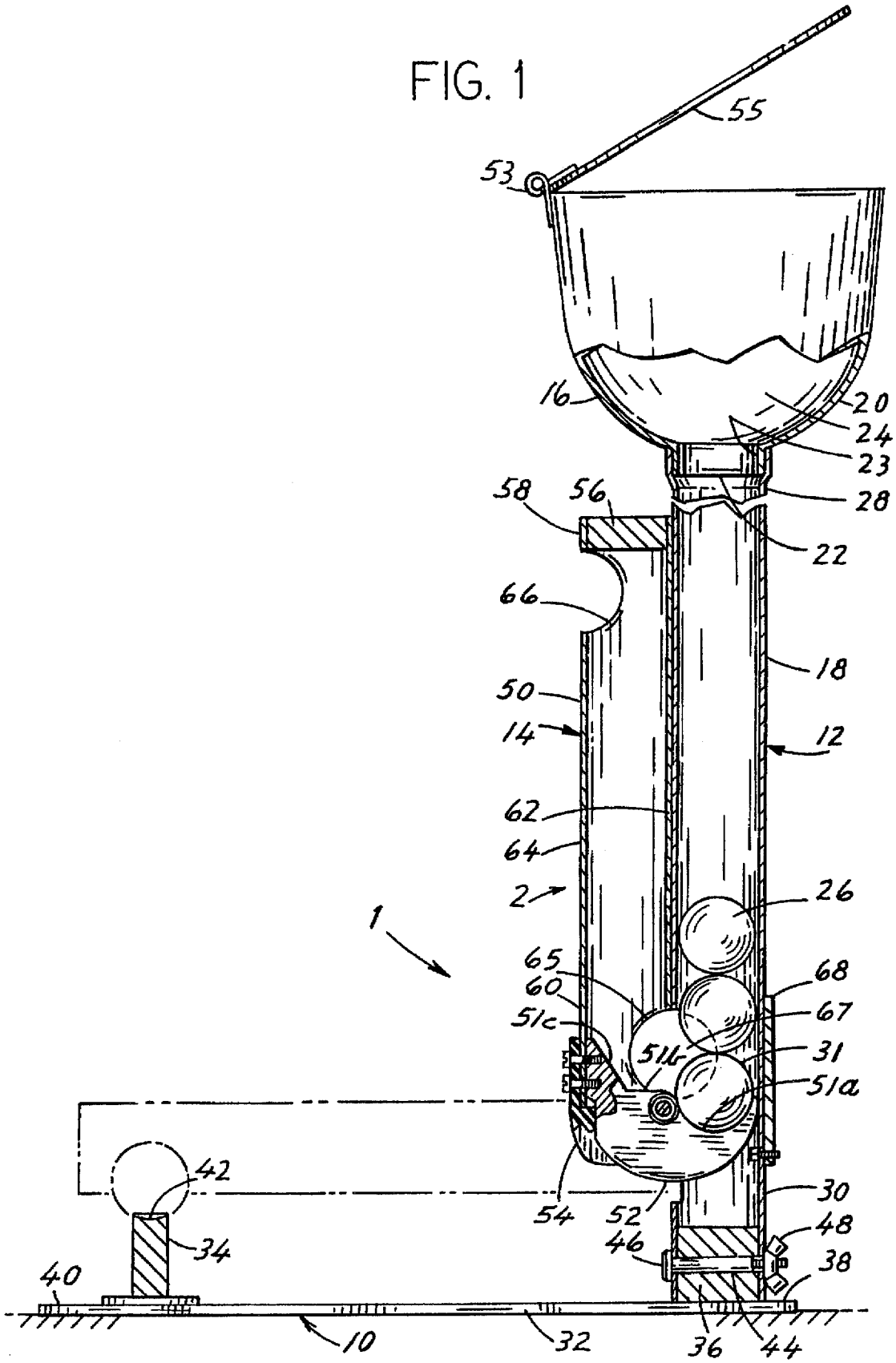
FIG. 1 is a cross sectional side detail view of an automatic golf ball dispenser in accordance with the present invention.

With reference now to the drawings, and particularly to FIG. 1, there is shown a cross sectional side detail view of an automatic golf ball dispenser 1. The automatic golf ball dispenser 1 includes a loading assembly 12, a base 10, and a delivery assembly 14. The loading assembly 12 comprises a bowl 16 and a supply tube 18. The bowl 16 has a first end 20, a second end 22, and a substantial volume 24. The opening at the first end 20 of the bowl 16 is substantially larger than the opening at the second end 22. The volume 24 of the bowl 16 is structured to hold a large number of golf balls 26. A cover 55 is pivotally connected to the first end 20 of the bowl 16 by a hinge 53. The cover 55 can protect golf balls in the bowl 16 if it should happen to rain. The supply tube 18 has a first end 28, a second end 30, a cutout 67, and a substantial length. The second end 22 of the bowl 16 is terminated with a neck 23 which is sized to snugly fit inside the first end 28 of the supply tube 18. The cutout 67 is disposed at substantially the second end of the supply tube 18.

The base 10 comprises a platform 32, a tee 34, and a projection 36. The platform has a first end 38, and a second end 40. The tee 34 is a cylinder of plastic which is fastened to the second end 40 of the platform 32. A small concave depression 42 is formed in the top of the tee 34 to hold a golf ball. The tee 34 is well known in the art. The projection 36 is disposed at the first end 38 of the platform 32 and is sized to slidably fit into the second end 30 of the supply tube 18. A bore 44 is formed through the second end 30 of the supply tube 18 and the projection 36 such that a bolt 46 may be inserted therethrough and rigidly retain the loading assembly in relation to the platform with a tightened wing nut 48. The delivery unit 2 comprises the loading assembly 12 and the delivery assembly 14. The delivery unit 2 can be separated from the base 10 by loosening the wing nut 48 and with drawing the bolt 46. The base 10 can be permanently mounted to the ground and the delivery unit 2 easily removed for storage. The delivery unit 2 and base 10 can also be easily transported by hand after separating thereof.

The delivery assembly 14 comprises a delivery tube 50, a loading interface 52, a stop 54, and a plug 56. The delivery tube 50 has a first end 60, a second end 58, a top surface 62, a bottom surface 64, and a substantial length. The plug 56 is inserted into the first end 58 of the delivery tube 50. A second cutout 66 is formed at substantially the second end 58 of the delivery tube 50 in the bottom surface 64 thereof, the second cutout 66 originates at the end of the plug 56. The second cutout 66 is sized to allow the golf ball 26 to pass through the delivery tube 50 on to the tee 34. The loading interface 52 is fastened to the first end 60 of the delivery tube 50. A first cutout 65 is formed at the first end 60 of the delivery tube 50 in the top surface 62 thereof, the first cutout 65 originates at the end of the loading interface 52. The first cutout 65 is sized to allow a golf ball 26 to pass from the supply tube 18 into the delivery tube 50.

Figure 2:
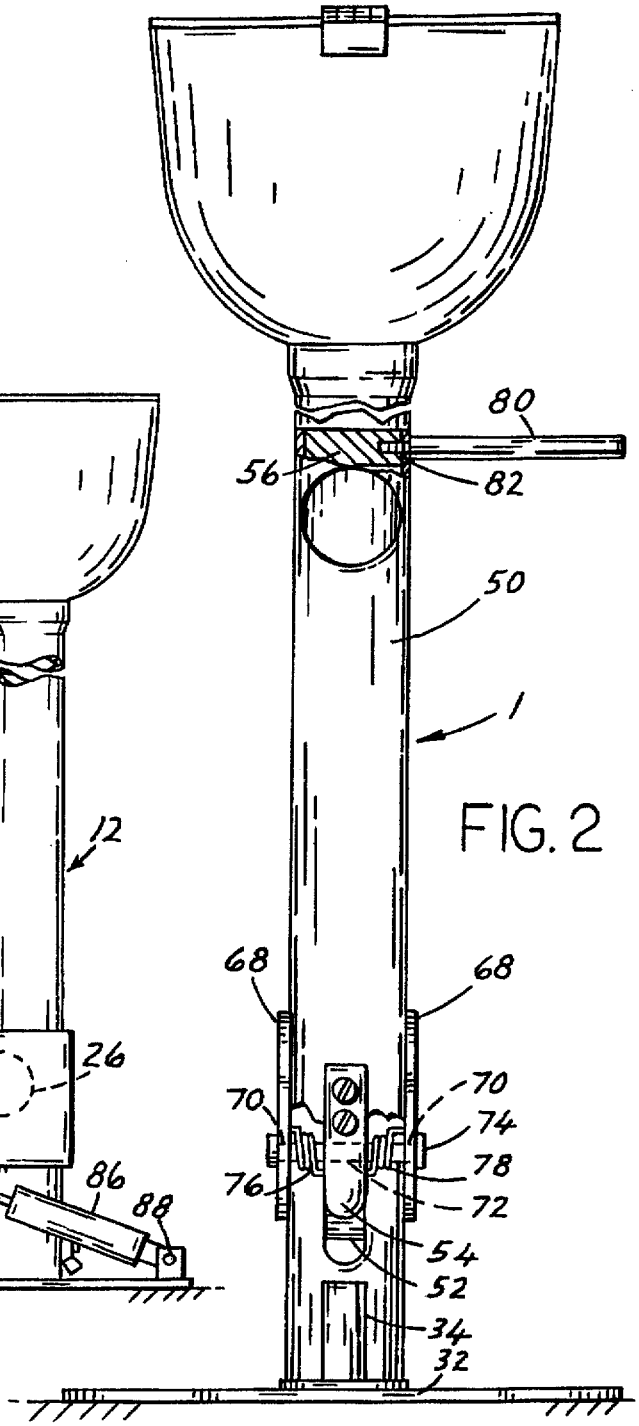
FIG. 2 is a front detail view of an automatic golf ball dispenser in accordance with the present invention.

With reference to FIG. 2, a pivot bracket 68 is fastened to the supply tube 18 at substantially the second end 30 thereof. The pivot bracket 68 has a U-shaped cross section which fits securely around the diameter of the supply tube 18. A bore 70 is formed throug5 the pivot bracket 68, and a bore 72 is formed through the loading interface 52, a pin 74 is passed through the bore 70 and bore 72. The loading assembly 12 pivots in relation to the delivery assembly 14. The stop 54 is fastened to the bottom surface 64 of the of the delivery tube 50 at the first end 60 thereof.

FIG. 2 shows a front detail view of the automatic golf ball dispenser 1. A first torsion spring 76 is fastened to one side of the pivot bracket 68 and one side of the loading interface 52. A second torsion spring 78 is fastened to the other side of the pivot bracket 68 and the other side of the loading interface 52. When the delivery assembly is swung downward, the spring force of the first radial spring 76 and second radial,spring 78 will cause the delivery assembly 14 to return to an upright position. An adjusting rod 80 is tapped into the plug 56 through a slot 82 in delivery tube 50. The slot 82 allows the plug 56 to be adjusted along the center axis of the delivery tube 50. The plug 56 is held in position by tightening the adjusting rod 80 in relation to the plug 56. The location of the plug 56 within the delivery tube 50 is critical for placing the golf ball 26 on the tee 34. If the golf ball 26 is not positioned properly in relation to the tee 34, when the delivery assembly 14 is in a placement position, the golf ball 26 will fall off the tee 34 when the delivery assembly 14 retracts to the upright position. The adjusting rod 80 may also be used to swing the delivery assembly 14 to the placement position during semi-automatic operation.

Figure 3:
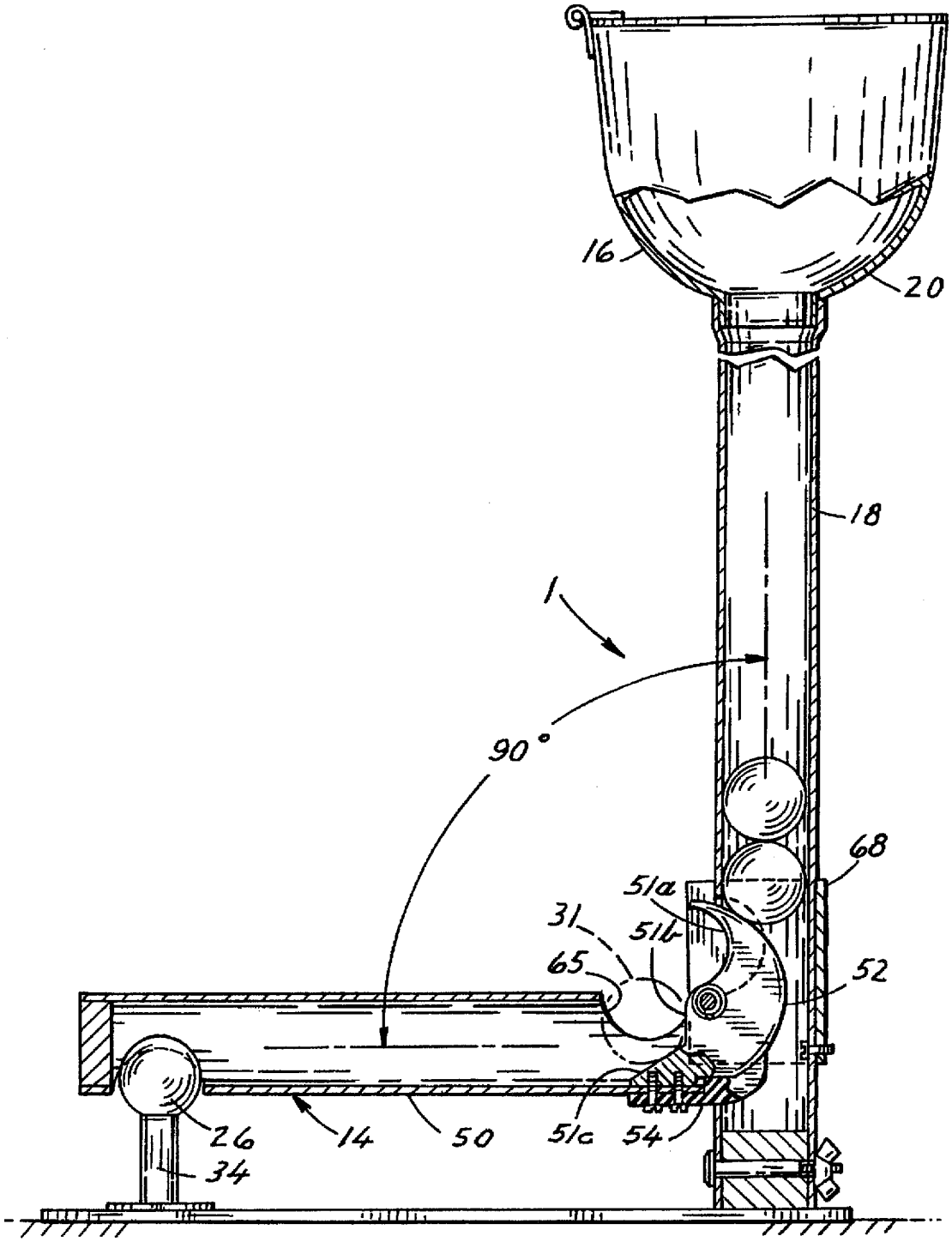
FIG. 3 is a cross sectional side detail view of an automatic golf ball dispenser with a delivery assembly placing a golf ball on a tee in accordance with the present invention.

FIG. 3 shows a cross sectional side detail view of an automatic golf ball dispenser with the loading assembly 14 placing a golf ball 26 on a tee 34. With reference to FIG. 1, a large number of golf balls 26 are placed in the bowl 16 and fall down the supply tube 18 until the first golf ball 31 contacts the first profile 51*a* of the loading interface 52. As the delivery assembly 14 is swung downward, the first golf ball 31 falls through the cutout 67 in the supply tube 50 and first cutout 65 in the delivery tube 50 and contacts the second profile 51*b* of the loading interface 52. The first golf ball 31 rolls down the third profile 51*c* of the loading interface 52 when the delivery assembly 14 is swung completely downward. The loading assembly 14 will swing downward until the stop 54 contacts the supply tube 18. The maximum angular swing of the delivery tube as limited by the stop 54 is greater than 90 degrees to allow gravity to pull the golf ball 26 down the delivery tube 50. When the delivery tube 50 is released, a golf ball 26 is placed on the tee 34.

Figure 4:
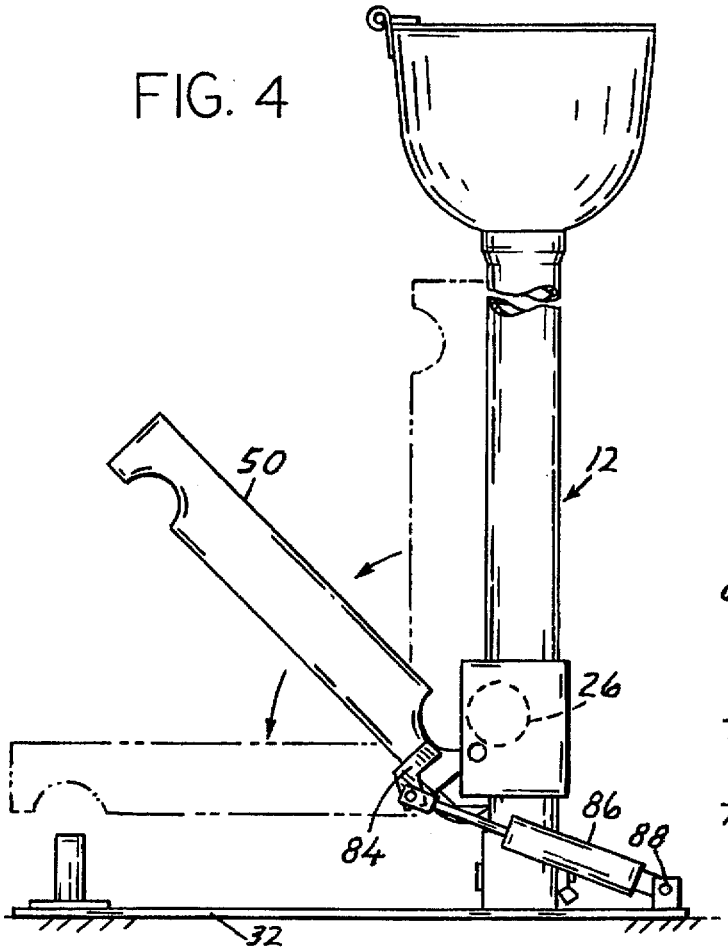
FIG. 4 is a side detail view of an automatic golf ball dispenser with an electric cylinder for swinging the delivery tube in accordance with the present invention.

FIG. 4 shows a side detail view of an automatic golf ball dispenser 1 with an electric cylinder 86 for swinging the delivery tube 50 into position for delivery of a golf ball 26. A delivery tube pivot 84 is fastened to the first end 60 of the delivery tube 50 and a platform pivot 88 is fastened to the platform 32. One end of the electric cylinder 86 is pivotal connected to the delivery tube pivot 84 and the other end of the electric cylinder 86 is pivotally connected to the platform pivot 88. The automatic golf ball dispenser 1 can be made fully automatic by using the electric cylinder 86 shown in FIG. 4 or by any other automated device means such as a motor with mechanical linkage, or a pneumatic cylinder. The operation of placing the golf ball 26 on the tee 34 can be activated by depressing a foot pedal switch which causes the electric cylinder 86 to cycle.

It is also possible to use another trigger means such as a photosensor which detects the presence of the golf ball 26 on the tee 42 instead of a foot pedal switch. If the golf is missing, the photosensor sends a message to the automated device to lower the delivery tube 14 which places another golf ball on the tee.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An automatic golf ball dispenser comprising:

a platform having a first end and a second end;

a tee being fastened to said second end of said platform;

a delivery unit having a delivery tube and a supply tube;

said delivery tube having a first end and a second end, a first cutout at said first end of said delivery tube, and a second cutout at said second end of said delivery tube;

said supply tube having a first end, a second end, and a cutout located at substantially said second end of said supply tube, said second end of said supply tube being fastened to said first end of said platform, said first end of said delivery tube being pivotally connected to said supply tube at substantially said second end thereof; and a projection being fastened to said first end of said platform, said projection slidably fitting into said second end of said supply tube, a bolt and a wing nut rigidly retaining said delivery unit relative to said platform, wherein said delivery unit being easily detachable from said platform by unthreading said wing nut, and removing said bolt.

2. The automatic golf ball dispenser of claim 1, further comprising:

a bowl having a first end, a second end, a substantial volume, and a neck disposed at said second end, said bowl being able to hold a large quantity of the golf balls, said neck of said bowl being sized to snugly fit inside said first end of said supply tube;

a cover; and a hinge being pivotally connected to said cover and said first end of said bowl, wherein the golf balls being protected from rain when cover is placed over said bowl.

3. The automatic golf ball dispenser of claim 2, further comprising:

a loading interface being fastened to said first end of said delivery tube, said first cutout of said delivery tube being sized to allow a golf ball to pass therethrough from said supply tube; and a stop being fastened to said delivery tube at said first end thereof, wherein said delivery tube pivots downward relative to said supply tube, said stop contacting said supply tube such that the maximum angular swing of said delivery tube being limited by said stop.

4. The automatic golf ball dispenser of claim 1, further comprising:

a triggering means; and an automated device means being cycled by said triggering means, wherein when said triggering means is actuated, said delivery tube being lowered by said automated means and placing the golf ball on said tee.

5. The automatic golf ball dispenser of claim 4, further comprising:

a foot pedal switch;

a platform pivot being fastened to said platform;

a delivery tube pivot being fastened to said delivery tube; and an electric cylinder, one end being pivotally connected to said platform pivot, the other end of said electric cylinder being pivotally connected to said delivery tube pivot, wherein the golf ball being placed on said tee when said electric cylinder is cycled by depressing said foot pedal switch.

6. The automatic golf ball dispenser of claim 1, further comprising:

an adjusting rod being inserted through a slot in said delivery tube at said second end thereof, said adjusting rod being tapped into a plug, said slot allowing said plug to be adjusted along the center axis of said delivery tube, the location of said plug being maintained by tightening said adjusting rod.

7. The automatic golf ball dispenser of claim 1, further comprising:

a pivot bracket being fastened to said supply tube at substantially said second end thereof, said delivery tube being pivotally connected to said pivot bracket.

8. An automatic golf ball dispenser comprising:

a platform having a first end and a second end;

a tee being fastened to said second end of said platform;

a delivery unit having a delivery tube and a supply tube;

said delivery tube having a first end and a second end, a first cutout at said first end of said delivery tube, and a second cutout at said second end of said delivery tube;

said supply tube having a first end, a second end, and a cutout located at substantially said second end of said supply tube, said second end of said supply tube being fastened to said first end of said platform, said first end of said delivery tube being pivotally connected to said supply tube at substantially said second end thereof;

a projection being fastened to said first end of said platform, said projection slidably fitting into said second end of said supply tube, a bolt and a wing nut rigidly retaining said delivery unit relative to said platform, wherein said delivery unit being easily detachable from said platform by unthreading said wing nut and removing said bolt; and an adjusting rod being inserted through a slot in said delivery tube at said second end thereof, said adjusting rod being tapped into a plug, said slot allowing said plug to be adjusted along the center axis of said delivery tube, the location of said plug being maintained by tightening said adjusting rod.

9. The automatic golf ball dispenser of claim 8, further comprising:

a bowl having a first end, a second end, a substantial volume, and a neck disposed at said second end, said bowl being able to hold a large quantity of the golf balls, said neck of said bowl being sized to snugly fit inside said first end of said supply tube;

a cover; and a hinge being pivotally connected to said cover and said first end of said bowl, wherein the golf balls being protected from rain when cover is placed over said bowl.

10. The automatic golf ball dispenser of claim 9, further comprising:

a loading interface being fastened to said first end of said delivery tube, said first cutout of said delivery tube being sized to allow a golf ball to pass therethrough from said supply tube; and a stop being fastened to said delivery tube at said first end thereof, wherein said delivery tube pivots downward relative to said supply tube, said stop contacting said supply tube such that the maximum angular swing of said delivery tube being limited by said stop.

11. The automatic golf ball dispenser of claim 8, further comprising:

a pivot bracket being fastened to said supply tube at substantially said second end thereof, said delivery tube being pivotally connected to said pivot bracket.

12. The automatic golf ball dispenser of claim 8, further comprising:

a triggering means; and an automated device means being cycled by said triggering means, wherein when said triggering means is actuated, said delivery tube being lowered by said automated means and placing the golf ball on said tee.

13. The automatic golf ball dispenser of claim 12, further comprising:

a foot pedal switch;

a platform pivot being fastened to said platform;

a delivery tube pivot being fastened to said delivery tube; and an electric cylinder, one end being pivotally connected to said platform pivot, the other end of said electric cylinder being pivotally connected to said delivery tube pivot, wherein the golf ball being placed on said tee when said electric cylinder is cycled by depressing said foot pedal switch.

14. An automatic golf ball dispenser comprising:

a platform having a first end and a second end;

a tee being fastened to said second end of said platform;

a delivery unit having a delivery tube and a supply tube;

said delivery tube having a first end and a second end, a first cutout at said first end of said delivery tube, and a second cutout at said second end of said delivery tube;

said supply tube having a first end, a second end, and a cutout located at substantially said second end of said supply tube, said second end of said supply tube being fastened to said first end of said platform, said first end of said delivery tube being pivotally connected to said supply tube at substantially said second end thereof; and an adjusting rod being inserted through a slot in said delivery tube at said second end thereof, said adjusting rod being tapped into a plug, said slot allowing said plug to be adjusted along the center axis of said delivery tube, the location of said plug being maintained by tightening said adjusting rod.

15. The automatic golf ball dispenser of claim 14, further comprising:

a projection being fastened to said first end of said platform, said projection slidably fitting into said second end of said supply tube, a bolt and a wing nut rigidly retaining said delivery unit relative to said platform, wherein said delivery unit being easily detachable from said platform by unthreading said wing nut and removing said bolt.

16. The automatic golf ball dispenser of claim 14, further comprising:

a bowl having a first end, a second end, a substantial volume, and a neck disposed at said second end, said bowl being able to hold a large quantity of the golf balls, said neck of said bowl being sized to snugly fit inside said first end of said supply tube;

a cover; and a hinge being pivotally connected to said cover and said first end of said bowl, wherein the golf balls being protected from rain when cover is placed over said bowl.

17. The automatic golf ball dispenser of claim 14, further comprising:

a loading interface being fastened to said first end of said delivery tube, said first cutout of said delivery tube being sized to allow a golf ball to pass therethrough from said supply tube; and a stop being fastened to said delivery tube at said first end thereof, wherein said delivery tube pivots downward relative to said supply tube, said stop contacting said supply tube such that the maximum angular swing of said delivery tube being limited by said stop.

18. The automatic golf ball dispenser of claim 14, further comprising:

a pivot bracket being fastened to said supply tube at substantially said second end thereof, said delivery tube being pivotally connected to said pivot bracket.

19. The automatic golf ball dispenser of claim 14, further comprising:

a triggering means; and an automated device means being cycled by said triggering means, wherein when said triggering means is actuated, said delivery tube being lowered by said automated means and placing the golf ball on said tee.

20. The automatic golf ball dispenser of claim 14, further comprising:

a foot pedal switch;

a platform pivot being fastened to said platform;

a delivery tube pivot being fastened to said delivery tube; and an electric cylinder, one end being pivotally connected to said platform pivot, the other end of said electric cylinder being pivotally connected to said delivery tube pivot, wherein the golf ball being placed on said tee when said electric cylinder is cycled by depressing said foot pedal switch.

* * * * *